US010753363B2

(12) United States Patent
Kozaki

(10) Patent No.: US 10,753,363 B2
(45) Date of Patent: Aug. 25, 2020

(54) MONITORING DEVICE AND VACUUM PUMP

(71) Applicant: Shimadzu Corporation, Kyoto (JP)

(72) Inventor: Junichiro Kozaki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 632 days.

(21) Appl. No.: 15/408,542

(22) Filed: Jan. 18, 2017

(65) Prior Publication Data

US 2017/0306967 A1 Oct. 26, 2017

(30) Foreign Application Priority Data

Apr. 22, 2016 (JP) ..... 2016-086146

(51) Int. Cl.
*F04D 17/16* (2006.01)
*F04D 29/28* (2006.01)
(Continued)

(52) U.S. Cl.
CPC ..... *F04D 17/168* (2013.01); *F04D 19/042* (2013.01); *F04D 27/001* (2013.01);
(Continued)

(58) Field of Classification Search
CPC .... F04D 17/168; F04D 29/058; F04D 19/042; F04D 29/584; F04D 27/001; F05D 2260/607
See application file for complete search history.

(56) References Cited

U.S. PATENT DOCUMENTS

2009/0028720 A1* 1/2009 Tsunazawa ..... F04D 19/042 417/32
2014/0278201 A1* 9/2014 Shimizu ..... G01K 7/427 702/131
(Continued)

FOREIGN PATENT DOCUMENTS

JP 2006-194094 A 7/2006
WO WO 2013/161399 A 10/2013

OTHER PUBLICATIONS

Pfeiffer, Working with Turbopumps, 2003. (Year: 2003).*
Kernan, Pumps 101: Operation, Maintenance and Monitoring Basics, White Paper, 2010. (Year: 2010).*

*Primary Examiner* — Regis J Betsch
*Assistant Examiner* — Jeremy A Delozier
(74) *Attorney, Agent, or Firm* — Renner, Otto, Boisselle & Sklar, LLP

(57) ABSTRACT

A vacuum pump includes; a rotor, a stator, a motor, a heating section heating the pump base portion, a base temperature detection section detecting a temperature of the pump base portion, a rotor temperature detection section detecting a temperature equivalent as a physical amount equivalent to a temperature of the rotor, and a heating control section to control heating of the pump base portion by the heating section such that a detection value of the rotor temperature detection section falls within a predetermined target value range. A monitoring device comprises: an estimation section configured to estimate, based on multiple temperatures detected over time by the base temperature detection section, maintenance timing at which the temperature of the pump base portion reaches equal to or lower than a predetermined temperature; and an output section configured to output maintenance information based on the estimated maintenance timing.

5 Claims, 9 Drawing Sheets

(51) Int. Cl.

| | |
|---|---|
| ***F04D 25/06*** | (2006.01) |
| ***F04D 27/00*** | (2006.01) |
| ***F04D 29/58*** | (2006.01) |
| ***F04D 29/44*** | (2006.01) |
| ***F04D 29/058*** | (2006.01) |
| ***F04D 19/04*** | (2006.01) |

(52) U.S. Cl.
CPC ..... *F04D 29/058* (2013.01); *F04D 29/584* (2013.01); *F05D 2260/607* (2013.01)

(56) References Cited

U.S. PATENT DOCUMENTS

| | | | | |
|---|---|---|---|---|
| 2015/0114101 | A1 | 4/2015 | Enomoto | |
| 2015/0226229 | A1* | 8/2015 | Tsutsui ..... | F04D 19/042 415/47 |
| 2017/0260999 | A1* | 9/2017 | Kozaki ..... | F04D 19/042 |

* cited by examiner

ROTOR ROTATION SPEED
STOP
RATED
DECELERATION
ACCELERATION
STOP
ROTATION AT RATED SPEED
STOP STATE

MOTOR CURRENT I
E
ROCESS GAS EXHAUSTING
ROCESS GAS EXHAUSTING
ROCESS GAS EXHAUSTING
C
C
C
E
Ith

ROTOR TEMPERATURE Tr
Tmax
T1

BASE TEMPERATURE Tb
T2
Tmin
TIME
ONE DAY

ROTOR ROTATION SPEED
RATED
STOP
F
F
F
F

MOTOR CURRENT I
Ith

ROTOR TEMPERATURE Tr
Tmax
T1

BASE TEMPERATURE Tb
T2
Tmin
t12
t13
t20
SIX MONTHS
TIME

MONITORING DEVICE AND VACUUM PUMP

BACKGROUND OF THE INVENTION

1. Technical Field

The present invention relates to a monitoring device and a vacuum pump.

2. Background Art

A turbo-molecular pump is used as an exhaust pump for various semiconductor manufacturing devices. However, in exhausting at, e.g., an etching process, a reaction product is accumulated in the pump. In particular, the reaction product tends to be accumulated in a gas flow path on a pump downstream side. When accumulation of the reaction product progresses to such an extent that a clearance between a rotor and a stator is filled with the reaction product, various defects are caused. For example, the rotor becomes unrotatable due to fixing of the rotor and the stator together, or a rotor blade comes into contact with a stator side to cause damage. In a device described in Patent Literature 1 (WO 2013/161399 A), a method in which accumulation of such a reaction product in a pump is predicted based on a temporal change in a motor current value has been described.

However, in the method described in Patent Literature 1, the accumulated product is predicted based on the change in the motor current value. Thus, unless a gas type is known in advance, such prediction is not accurate, and it is difficult to make long-term prediction. For example, in the case of flowing argon gas as diluent gas of etching gas, when a mixture proportion of xenon gas is increased, a coefficient of thermal conductivity is low, and a rotor temperature tends to increase. For this reason, in the case of increasing the mixture proportion, it is inevitable to decrease a gas flow rate, considering a rotor creep life. On the other hand, even when the gas type varies, the motor current value does not greatly change as long as the gas flow rate is constant. For this reason, the motor current value decreases by a decrease in the gas flow rate. Such a decrease applies not only to diluent gas, but also to etching gas. The same applies to the case where etching gas is changed from light chlorine-based gas to heavy bromine-based gas. Thus, without gas type information previously provided, it is difficult to predict accumulation in the case where the rotor creep life is taken into consideration.

Further, the motor current value susceptibly responds to an operation state of the vacuum pump. Thus, in the method for predicting product accumulation based on the motor current value as in Patent Literature 1, there is a problem that a prediction accuracy is lowered.

SUMMARY OF THE INVENTION

A vacuum pump includes; a rotor, a stator provided at a pump base portion, a motor configured to drive the rotor, a heating section configured to heat the pump base portion, abase temperature detection section configured to detect a temperature of the pump base portion, a rotor temperature detection section configured to detect a temperature equivalent as a physical amount equivalent to a temperature of the rotor, and a heating control section configured to control heating of the pump base portion by the heating section such that a detection value of the rotor temperature detection section falls within a predetermined target value range. A monitoring device comprises: an estimation section configured to estimate, based on multiple temperatures detected over time by the base temperature detection section, maintenance timing at which the temperature of the pump base portion reaches equal to or lower than a predetermined temperature; and an output section configured to output maintenance information based on the estimated maintenance timing.

The vacuum pump further includes a rotation speed detection section configured to detect a rotation speed of the rotor and a current detection section configured to detect a motor current value of the motor. A determination section configured to determine, based on a temporal change in the rotation speed and the motor current value, whether or not the vacuum pump is in a gas inflow state is further provided, and the estimation section performs estimation based on the temperature detected by the base temperature detection section when the determination section determines as being in the gas inflow state.

The monitoring device further comprises: a storage section configured to store, for the multiple temperatures detected over time by the base temperature detection section, data sets in a data storage area, each data set containing a temperature and a detection time point thereof. The estimation section performs estimation based on the multiple data sets stored in the storage section.

The monitoring device further comprises: a data processing section configured to perform, for the data sets stored in the storage section, greater weighting on a data set whose detection time point is more recent. The estimation section performs estimation based on the data set weighted by the data processing section.

The data processing section performs averaging processing of reducing a data set number stored in the storage section, and stores a new data set in a free space of the data storage area formed by the averaging processing.

DETAILED DESCRIPTION OF THE EXEMPLARY EMBODIMENTS

Hereinafter, embodiments of the present invention will be described with reference to the drawings.

First Embodiment

Figure 1:
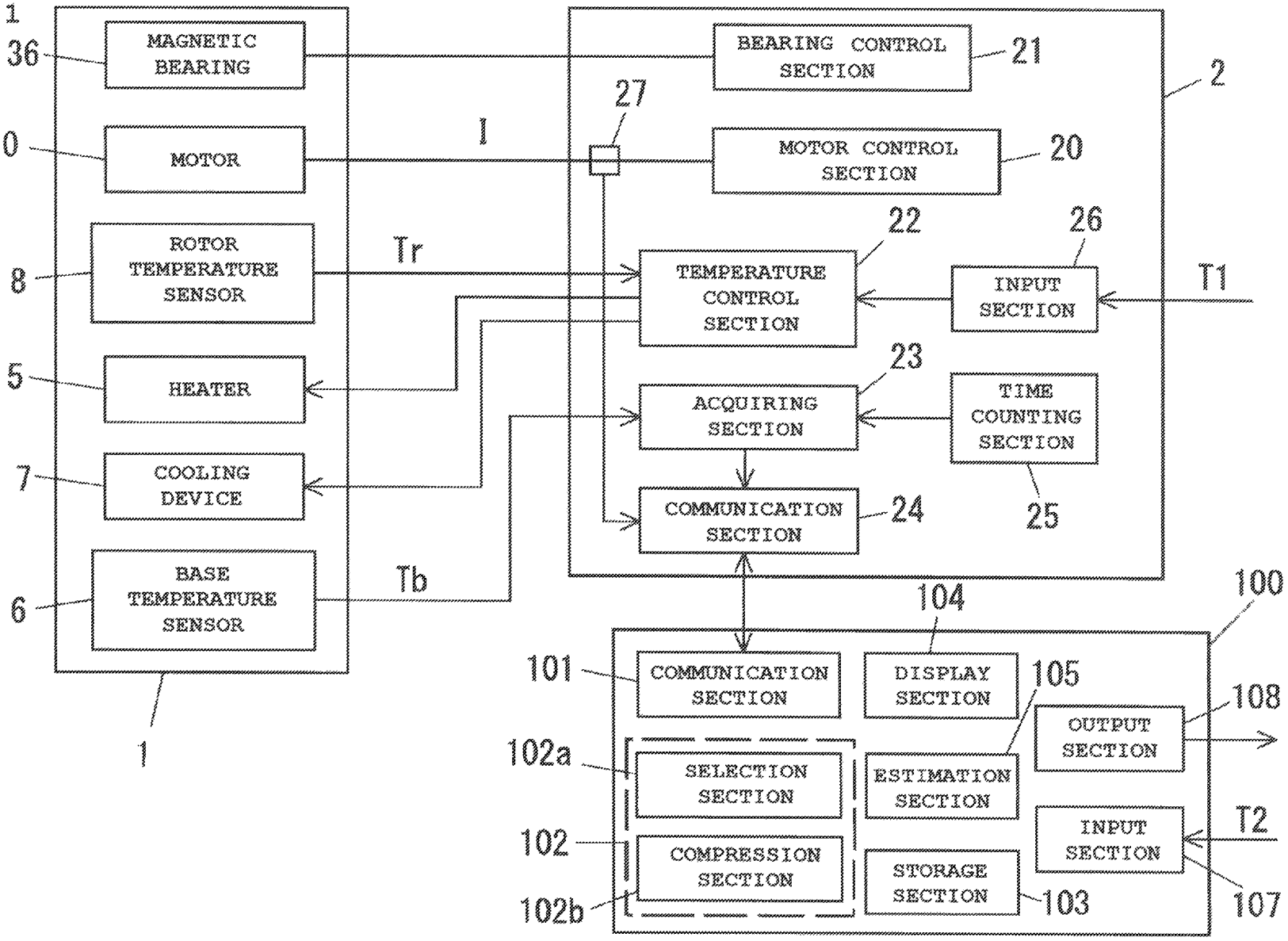
FIG. 1 is a block diagram of a schematic configuration of a pump system.
Figure 2:
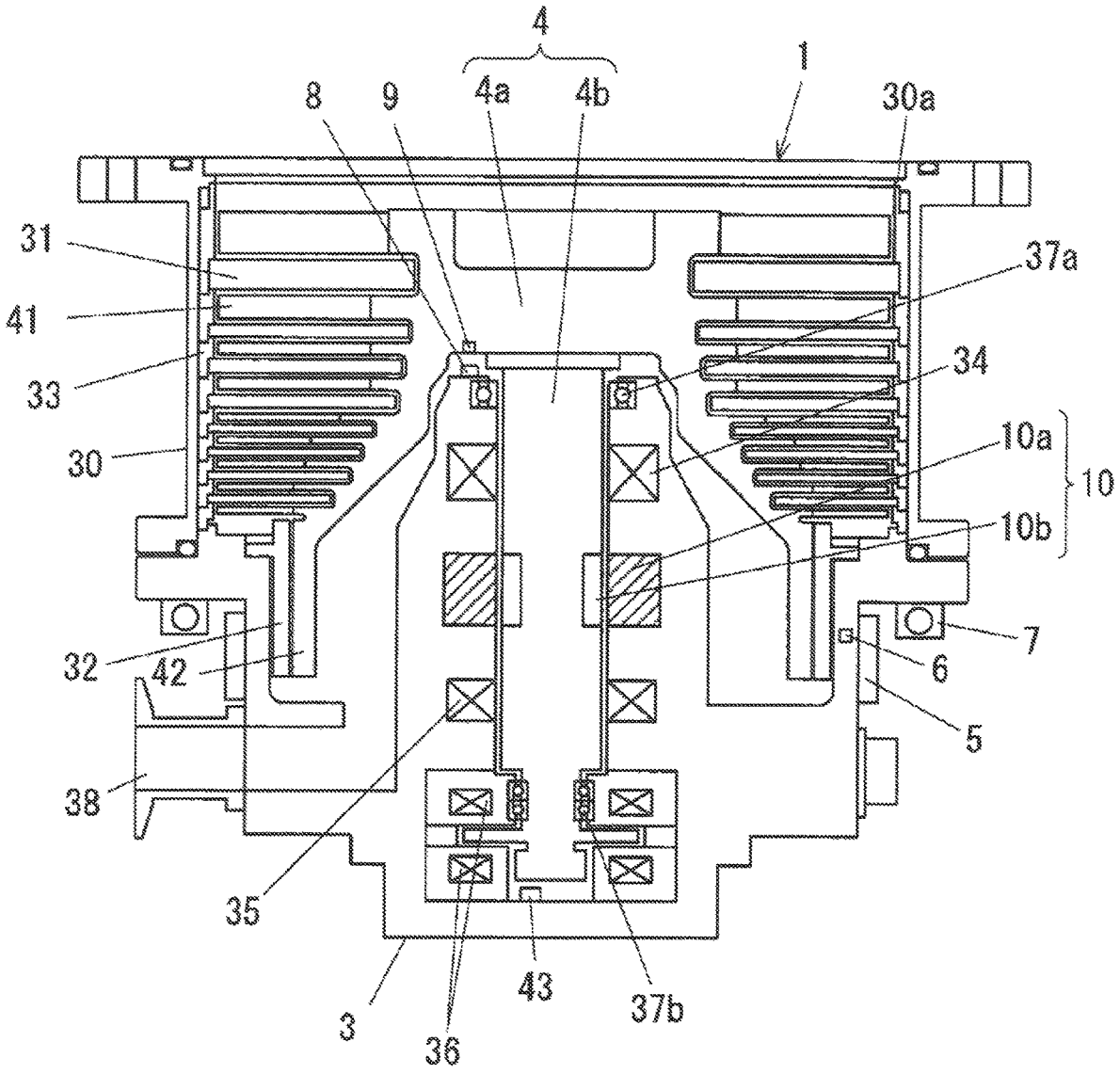
FIG. 2 is a cross-sectional view of an example of a pump body.

FIG. 1 is a diagram for describing an embodiment of the present invention, and is a block diagram of a schematic configuration of a pump system including a pump body 1, a control unit 2, and a monitoring device 100. Moreover, FIG. 2 is a cross-sectional view of an example of the pump body 1. A vacuum pump in the present embodiment is a magnetic bearing turbo-molecular pump, and FIG. 2 is a cross-sectional view of a schematic configuration of the pump body 1. Note that the present embodiment is not limited to the turbo-molecular pump, and is also applicable to other vacuum pumps.

As illustrated in FIG. 2, the pump body 1 includes a turbo pump stage having rotor blades 41 and stationary blades 31, and a screw groove pump stage having a cylindrical portion 42 and a stator 32. In the screw groove pump stage, a screw groove is formed at the stator 32 or the cylindrical portion 42. The rotor blades 41 and the cylindrical portion 42 are formed at a pump rotor 4*a*. The pump rotor 4*a* is fastened to a shaft 4*b*. The pump rotor 4*a* and the shaft 4*b* form a rotor unit 4.

The plurality of stationary blades 31 and the plurality of rotor blades 41 are alternately arranged in an axial direction. Each stationary blade 31 is placed on a base 3 with spacer rings 33 being interposed therebetween. When a pump case 30 is bolted to the base 3, the stack of the spacer rings 33 is sandwiched between the base 3 and a lock portion 30*a* of the pump case 30, and in this manner, the stationary blades 31 are positioned.

The shaft 4*b* is supported by magnetic bearings 34, 35, 36 provided at the base 3 without contact. Although not shown in detail in the figure, each of the magnetic bearings 34 to 36 includes electromagnets and a displacement sensor. The displacement sensor is configured to detect the levitation position of the shaft 4*b*. The rotation speed (the number of rotations per second) of the shaft 4*b*, i.e., the rotor unit 4, is detected by a rotation sensor 43.

The base 3 is provided with a heater 5 and a cooling device 7, these components being configured to adjust the temperature of the stator 32. In the example illustrated in FIG. 1, a cooling block provided with a flow path through which refrigerant circulates is provided as the cooling device 7. Although not shown in the figure, an electromagnetic valve configured to control ON/OFF of refrigerant inflow is provided at the refrigerant flow path of the cooling device 7. The base 3 is further provided with a base temperature sensor 6. Note that in the example illustrated in FIG. 1, the base temperature sensor 6 is provided at the base 3, but the base temperature sensor 6 may be provided at the stator 32.

Moreover, the temperature of the pump rotor 4*a* is detected by a rotor temperature sensor 8. As described above, the pump rotor 4*a* is magnetically levitated, and then, rotates at high speed. Thus, a non-contact temperature sensor is used as the rotor temperature sensor 8. For example, as described in JP-A-2006-194094, a non-contact temperature sensor is used, which utilizes a great change in the magnetic permeability of a ferromagnetic target around a Curie temperature. The rotor temperature sensor 8 is an inductance sensor, and is configured to detect, as an inductance change, a change in the magnetic permeability of a target 9 provided at the pump rotor 4*a*. The target 9 is formed of a ferromagnetic body. Note that the target 9 facing the rotor temperature sensor 8 may be provided at the position of the shaft 4*b*.

As illustrated in FIG. 1, the control unit 2 includes a motor control section 20, a bearing control section 21, a temperature control section 22, an acquiring section 23, a communication section 24, a time counting section 25, an input section 26, and a current detection section 27. A motor 10 is controlled by the motor control section 20, and a motor current value I is detected by the current detection section 27. The magnetic bearings 34 to 36 are controlled by the bearing control section 21.

The temperature control section 22 is configured to control heating by the heater 5 and cooling by the cooling device 7 based on a rotor temperature Tr detected by the rotor temperature sensor 8 and a predetermined temperature T1 input to the input section 26. The predetermined temperature T1 is a target rotor temperature in rotor temperature adjustment. Specifically, ON/OFF control of the heater 5 and ON/OFF control of refrigerant inflow of the cooling device 7 are performed. Note that in the present embodiment, temperature adjustment is performed using the heater 5 and the cooling device 7, but temperature adjustment may be performed only by ON/OFF of the heater 5.

The acquiring section 23 is configured to acquire, at predetermined timing based on time information of the time counting section 25, a base temperature Tb detected by the base temperature sensor 6. The acquiring section 23 acquires, as a data set (Tb, t), the base temperature Tb and a sampling time t. Such a set (Tb, t) is hereinafter referred to as a "base temperature data set." The communication section 24 provided at the control unit 2 outputs, e.g., the above described base temperature data set (Tb, t), the motor current value I, the rotation speed detected by the rotation sensor 43, and the state status of the vacuum pump. In the present embodiment, a motor operation state (stop, acceleration, deceleration, and rotation at a rated speed) is taken as the state status.

The monitoring device 100 is configured to inform maintenance timing for removing an accumulated substance based on the base temperature data set (Tb, t). The monitoring device 100 includes a communication section 101, a data processing section 102, a storage section 103, a display section 104, an estimation section 105, an input section 107, and an output section 108. For example, the base temperature data set (Tb, t), the motor current value I, the rotation speed, and the motor operation state (stop, acceleration, deceleration, and rotation at the rated speed) are input from the communication section 24 of the control unit 2 to the communication section 101.

The data processing section 102 includes a selection section 102*a* configured to perform selection processing for input data, and a compression section 102*b* configured to perform compression processing for data stored in the storage section 103. The selection section 102*a* determines, based on a temporal change in the motor current value I and the rotation speed, whether or not the pump body 1 is in a gas inflow state. Then, the selection section 102*a* selects, based on such a determination result, a base temperature data set (Tb, t) in the gas inflow state from sequentially-detected base temperature data sets (Tb, t).

The selected base temperature data set (Tb, t) is stored in the storage section 103. Note that a memory capacity for base temperature data sets (Tb, t) in the storage section 103 is limited, and for this reason, the compression section 102*b* performs the processing of reducing already-stored base temperature data sets (Tb, t) to store a newly-selected base temperature data set (Tb, t). Such reduction processing will be described below in detail.

The estimation section 105 is configured to estimate, based on the base temperature data set (Tb, t) selected by the selection section 102*a*, a period until the base temperature Tb reaches a predetermined temperature T2 as a threshold, i.e., the maintenance timing requiring removal of the accumulated substance. A warning on the maintenance timing is displayed on the display section 104. Moreover, maintenance warning information is output from the output section 108. The predetermined temperature T2 for estimation of an operable time is input from the input section 107.

Note that, e.g., a method in which an operator manually inputs the predetermined temperatures T1, T2 by operation of operation sections provided at the input sections 26, 107 is employed as the method for inputting the predetermined temperatures T1, T2. Alternatively, it may be configured such that the predetermined temperatures T1, T2 are set by a command from a higher-order controller. Note that unless otherwise set from the outside, standard values stored in advance are applied as T1, T2.

(Description of Temperature Adjustment Operation)

Next, an example of temperature adjustment operation by the temperature control section 22 will be described. As described above, in exhausting at, e.g., an etching process, a product is easily accumulated in the pump. In particular, the product tends to be accumulated in a gas flow path at the stator 32, the cylindrical portion 42, and the base 3 on a pump downstream side. With an increase in accumulation at the stator 32 and the cylindrical portion 42, a clearance between the stator 32 and the cylindrical portion 42 is narrowed by the accumulated substance, and for this reason, the stator 32 and the cylindrical portion 42 might contact each other or might be fixed together. For this reason, the heater 5 and the cooling device 7 are provided to control a base portion temperature to a high temperature to reduce accumulation of the product in the gas flow path at the stator 32, the cylindrical portion 42, and the base 3. This temperature adjustment operation will be described later.

Generally, an aluminum material is used for the pump rotor 4*a* of the turbo-molecular pump, and therefore, the temperature (the rotor temperature Tr) of the pump rotor 4*a* includes an allowable temperature for creep stain, the allowable temperature being unique to the aluminum material. Since the pump rotor 4*a* rotates at high speed in the turbo-molecular pump, a high centrifugal force acts on the pump rotor 4*a* in a high speed rotation state, leading to a high tensile stress state. In such a high tensile stress state, when the temperature of the pump rotor 4*a* reaches equal to or higher than the allowable temperature (e.g., 120° C.), the speed of creep deformation increasing permanent strain can no longer be ignored.

When operation continues at equal to or higher than the allowable temperature, the creep strain of the pump rotor 4*a* increases, and accordingly, the diameter dimension of each portion of the pump rotor 4*a* increases. Thus, the clearance between the cylindrical portion 42 and the stator 32 and a clearance among the rotor blades 41 and the stationary blades 31 are narrowed, and therefore, these components might contact each other. Considering the creep strain of the pump rotor 4*a* as described above, operation is preferably performed at equal to or lower than the allowable temperature. On the other hand, for reducing accumulation of the product to further extend a maintenance interval for removal of the accumulated substance, the base temperature Tb is preferably held higher by temperature adjustment.

In the present embodiment, the heater 5 and the cooling device 7 are controlled such that the rotor temperature Tr detected by the rotor temperature sensor 8 reaches a predetermined temperature or falls within a predetermined temperature range. In this manner, a proper temperature placing a priority on extension of the life of the pump rotor 4*a* against the creep strain is maintained while the interval of maintenance against accumulation of the product is extended.

Figure 3A:
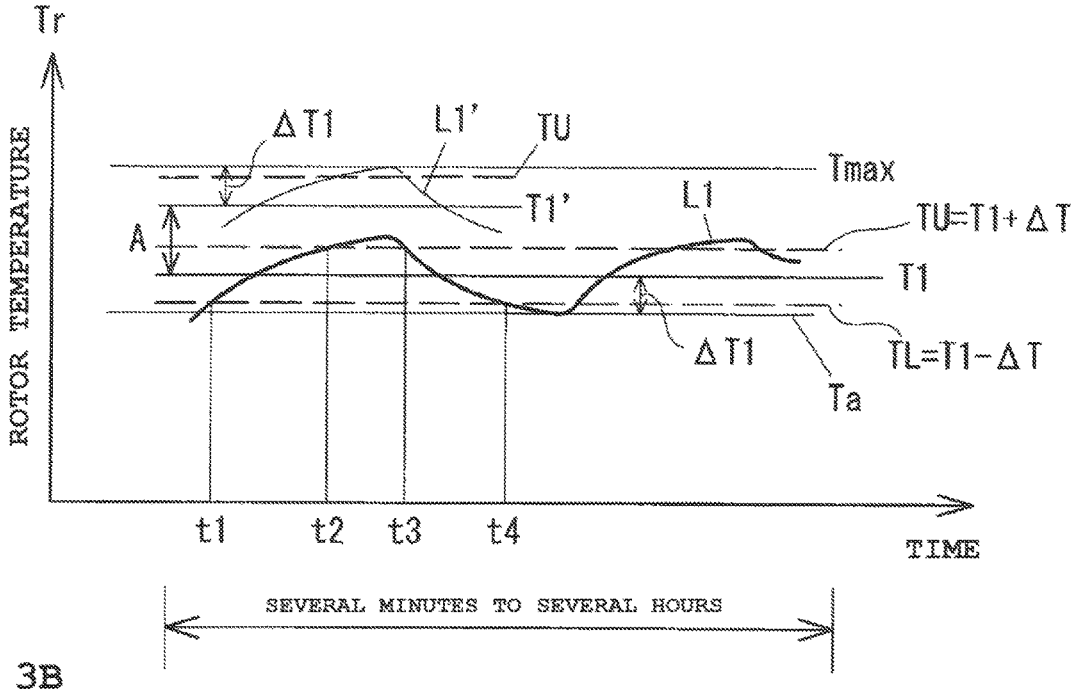
FIGS. 3A and 3B are graphs of an example of transition of a rotor temperature Tr and a base temperature Tb for a short period of time.
Figure 3B:
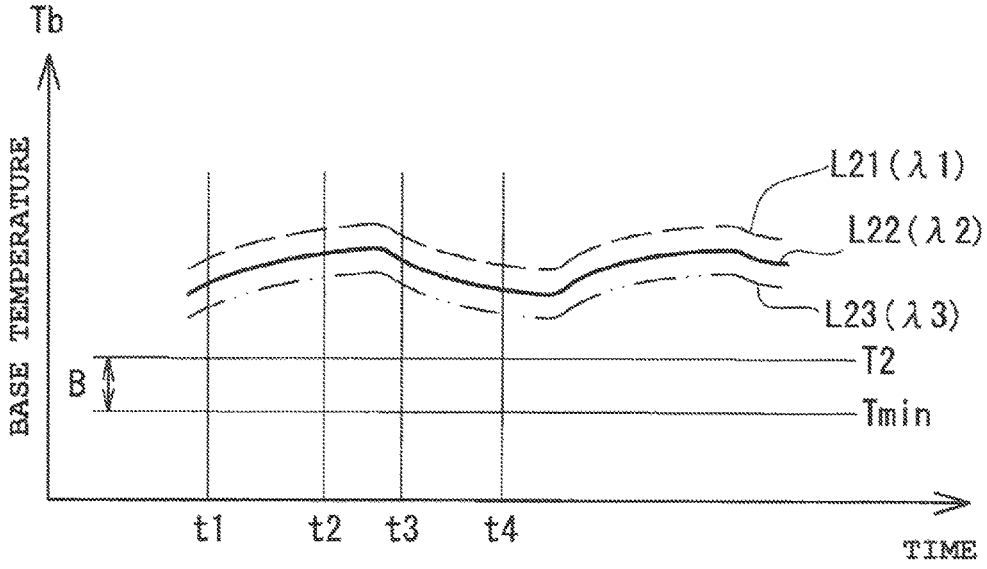

FIGS. 3A and 3B are graphs of an example of transition of the rotor temperature Tr and the base temperature Tb for a short period of time when heating and cooling (i.e., temperature adjustment) of a base portion are performed such that the rotor temperature Tr reaches the predetermined temperature T1. The "short period of time" as described herein is a time range of several minutes to several hours.

FIG. 3A is the graph of transition of the rotor temperature Tr. As described above, the predetermined temperature T1 is the control target temperature of the rotor temperature Tr in temperature adjustment of the base portion. Curves L21, L22, L23 of FIG. 3B show transition of the base temperature Tb. The curves L21, L22, L23 are different from each other in the type of gas to be exhausted. Reference characters "λ1," "λ2," and "λ3" each represent a coefficient of thermal conductivity of gas, and are in a magnitude relationship of λ1>λ2>λ3.

The pump rotor 4*a* rotates at high speed in gas to perform exhausting. Thus, the pump rotor 4*a* generates heat due to friction with the gas. On the other hand, a heat dissipation amount from the pump rotor 4*a* to the stationary blades and the stator depends on the coefficient of thermal conductivity of gas, and a higher coefficient of thermal conductivity of gas results in a greater heat dissipation amount. As a result, in the case of a lower coefficient of thermal conductivity of gas, the heat dissipation amount from the pump rotor 4*a* is smaller, and the rotor temperature Tr is higher. That is, for the same gas flow rate and the same base temperature Tb, a lower coefficient of thermal conductivity of gas results in a higher rotor temperature Tr.

In the present embodiment, heating and cooling of the base portion are controlled such that the rotor temperature Tr reaches the predetermined temperature T1, and therefore, a lower coefficient of thermal conductivity of gas results in a lower base temperature Tb. In the example of FIG. 3B, λ1>λ2>λ3 is satisfied. Thus, the base temperature Tb is lowest in the curve L23 with the thermal conductivity coefficient λ3, and the rotor temperature Tr increases in the order of the curves L22, L21.

When the predetermined temperature T1 is input to the input section 26 of FIG. 2, the predetermined temperature T1 is input from the input section 26 to the temperature control section 22. When the predetermined temperature T1 is input, the temperature control section 22 sets, to upper and lower temperatures with respect to the predetermined temperature T1, a target upper temperature limit TU (=T1+ΔT) and a target lower temperature limit TL (=T1−ΔT) for controlling ON/OFF of the heater 5 and the cooling device 7. Then, based on the input predetermined temperature T1 and the rotor temperature Tr, ON/OFF of the heater 5 and the cooling device 7 is controlled such that the rotor temperature Tr reaches the predetermined temperature T1.

When the rotor temperature Tr exceeds, in a positive direction, the target lower temperature limit TL at a time point t1 of FIG. 3A, the temperature control section 22 turns off the heater 5 from an ON state to stop heating. When heating of the base portion by the heater 5 is stopped, a heat transfer amount from the base portion (the stator 32) to the pump rotor 4*a* decreases, leading to a decrease in the rise rate of the rotor temperature Tr. Subsequently, when the rotor temperature Tr exceeds, in the positive direction, the target upper temperature limit TU at a time point t2, the temperature control section 22 turns on the cooling device 7 to start cooling of the base portion. When the temperature of the stator 32 is decreased by cooling, heat is transferred from the pump rotor 4*a* to the stator 32. After a period of time from start of cooling, the rotor temperature Tr begins decreasing.

When the rotor temperature Tr decreases and exceeds, in a negative direction, the target upper temperature limit TU at a time point t3, the temperature control section 22 turns off the cooling device 7. As a result, heat transfer from the cylindrical portion 42 to the stator 32 decreases, and the decline rate of the rotor temperature Tr gradually lowers. Subsequently, when the rotor temperature Tr exceeds, in the negative direction, the target lower temperature limit TL at a time point t4, the temperature control section 22 turns on the heater 5 to resume heating of the base portion. When the temperature of the stator 32 is increased by heater heating, heat is transferred from the stator 32 to the cylindrical portion 42, and the rotor temperature Tr begins increasing. As described above, when the temperatures of the base 3 and the stator 32 are increased/decreased by heating/cooling of the base portion, the temperature (the rotor temperature Tr) of the pump rotor 4*a* accordingly increases/decreases.

Figure 4A:
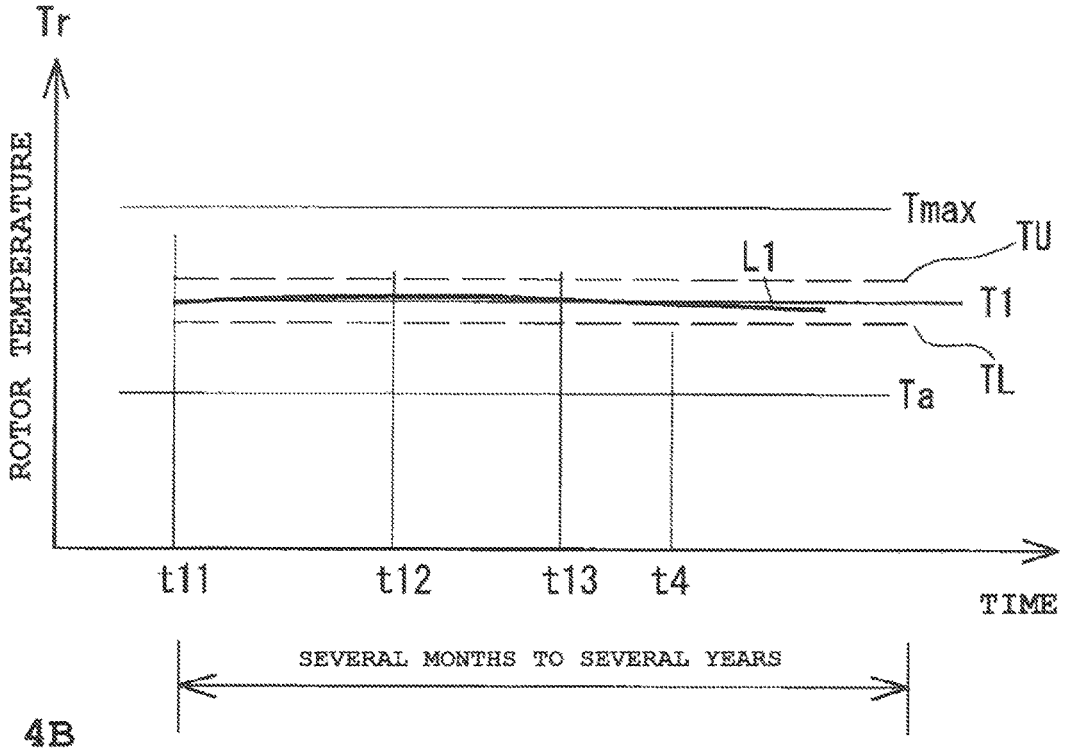
FIGS. 4A and 4B are graphs of an example of transition of the rotor temperature Tr and the base temperature Tb for a long period of time.
Figure 4B:
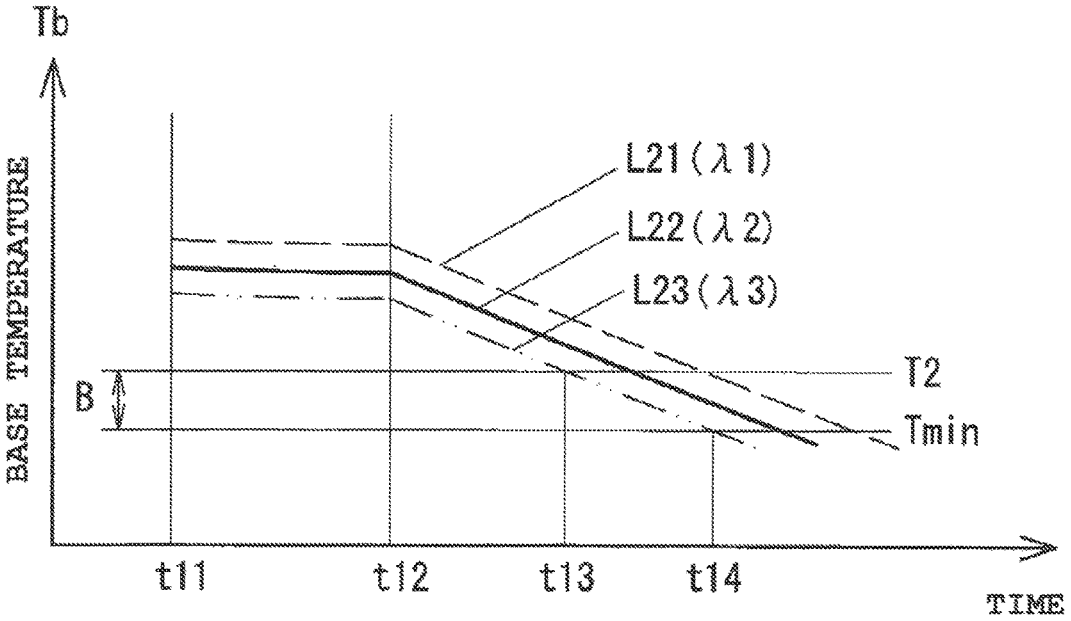

FIGS. 4A and 4B are graphs of an example of transition of the rotor temperature Tr and the base temperature Tb for a long period of time when heating and cooling of the base portion are performed such that the rotor temperature Tr reaches the predetermined temperature T1. The "long period of time" as described herein is a period of several months to several years. Accumulation of the product is reduced by temperature adjustment of the base portion by the heater 5 and the cooling device 7, but such accumulation still gradually progresses.

As the gas flow path becomes narrower due to accumulation of the product in the pump, the pressure of a turbine blade portion increases. With an increase in the pressure of the turbine blade portion, a motor current required for maintaining a rotor rotation speed at a rated rotation speed increases, and heat generation due to gas exhausting increases. As a result, the rotor temperature tends to increase. Since temperature adjustment is performed such that the rotor temperature Tr reaches the predetermined temperature T1, when the rotor temperature Tr tends to increase due to accumulation of the product, the amount of heating of the base portion decreases. That is, the base temperature Tb decreases with an increase in accumulation of the product.

In the example shown in FIGS. 4A and 4B, for a period of time after start of use of the pump at a time point t11, the amount of accumulation of the product is not an amount influencing the rotor temperature Tr, and for this reason, the base temperature Tb is substantially maintained constant. However, after a time point t12 at which the amount of accumulation has been increased to some extent, the amount of heating of the base decreases to suppress an increase in the rotor temperature Tr, and the base temperature begins decreasing. Then, the base temperature Tb shown by the curve L23 reaches the predetermined temperature T2 at a time point t13, and further reaches an operable lower temperature limit Tmin at a time point t14.

In FIGS. 3A, 3B, 4A, and 4B, Tmax is an operable upper temperature limit of the turbo-molecular pump. When the rotor temperature Tr exceeds the operable upper temperature limit Tmax, the creep strain of the pump rotor 4*a* can no longer be ignored, leading to greater influence on life shortening. For this reason, the predetermined temperature T1 is set to, e.g., TU<Tmax such that the rotor temperature Tr does not exceed the operable upper temperature limit Tmax. As long as the rotor temperature Tr is equal to or lower than the operable upper temperature limit Tmax, the influence of the creep strain is small, and therefore, the creep life of the pump rotor 4*a* can be maintained at equal to or greater than a predetermined value.

However, when the predetermined temperature T1 is set to an extremely-low temperature, the base temperature Tb in temperature adjustment is equal to or lower than the predetermined temperature T2, and the amount of accumulation of the product increases, leading to a shorter maintenance interval. For this reason, based on an assumption that the gas showing the curves L21, L22, L23 is used, the predetermined temperature T1 is, in an initial pump operation state, preferably set such that the curves L21, L22, L23 of the base temperature Tb show a higher temperature than the predetermined temperature T2, as shown in FIG. 4B.

In the examples of FIGS. 3A, 3B, 4A, and 4B, a temperature Ta as a lower limit when the predetermined temperature T1 is set is a value obtained based on an assumption of the case up to the gas showing the curve L23. A gas flow rate is set for one, which has the lowest coefficient of thermal conductivity, of plural types of gas to be exhausted, and then, the temperature Ta is set such that the position of the curve L23 (the base temperature Tb) is on a high-temperature side than the predetermined temperature T2 when the rotor temperature Tr reaches the temperature Ta. As described above, the temperature Ta is the lower limit of the rotor temperature Tr for not decreasing the base temperature Tb below the predetermined temperature T2 in the initial pump operation state.

The lower limit of the predetermined temperature T1 is such a lower temperature limit of the rotor temperature Tr that the base temperature Tb does not fall below the predetermined temperature T2, and FIG. 3A illustrates the case where the predetermined temperature T1 is set to the lower limit. On the other hand, a curve L1' of FIG. 3A indicates the case where the predetermined temperature T1 is set to the upper limit. In this case, the rotor temperature Tr is controlled to equal to or lower than the operable upper temperature limit Tmax. That is, the predetermined temperature T1 is set within a range indicated by a reference character "A" in FIG. 3A. In the case where a temperature variation range of a curve L1 is 2ΔT1, the temperature range A is $Ta+\Delta T1 \leq T1 \leq Tmax-\Delta T1$.

Note that in the case where a gas type having a lower coefficient of thermal conductivity than that of a previously-assumed gas type is exhausted or even in the case where a standard predetermined temperature T1 is set regardless of gas type, the base portion temperature might, as a result, fall below the predetermined temperature T2 in the initial state. However, in such a case, a setting change for decreasing the value of the predetermined temperature T1 may be performed again.

The method for setting the predetermined temperature T1 may include, for example, a method in which a value giving the highest priority to the rotor life, i.e., a value of $T1=Ta+\Delta T1$, is set in advance as a default value of the predetermined temperature T1 and a user can input a desired value within a range of $Ta+\Delta T1 \leq T1 \leq Tmax-\Delta T1$ via the input section 26. The user can set the predetermined temperature T1 according to the level of weighting on both of the rotor life and the maintenance interval. That is, trade-off can be properly made for the rotor life and the maintenance interval. Moreover, it is also configured such that a default value is set in advance for the predetermined temperature T2 and the user can input a desired value via the input section 107. For example, in this case, a temperature substantially equal to a target temperature set for a typical base temperature to perform temperature adjustment is set as the default value of the predetermined temperature T2.

Alternatively, the sublimation temperature of the product or a temperature close to such a sublimation temperature may be used as the predetermined temperature T2. When the base temperature Tb falls below the predetermined temperature T2, the speed of accumulation of the product sharply increases. Examples of the operable lower temperature limit Tmin include a base temperature increasing the probability of causing, e.g., contact between the cylindrical portion 42 and the stator 32 due to significant accumulation of the product. However, it is difficult to exactly determine such a base temperature, and the base temperature is much susceptible to a process status or a pump condition. For this reason, the operable lower temperature limit Tmin is, only as a guide, set such that a temperature range B is equal to or lower than about 10° C. with respect to the predetermined temperature T2. Needless to say, the predetermined temperature T2 and the operable lower temperature limit Tmin may be determined by experiment or simulation under actual process conditions.

In FIGS. 3A, 3B, 4A, and 4B as described above, a temperature change during a process, i.e., a temperature change in the state in which gas flows into the pump, has been described as an example. However, in actual attachment to a semiconductor manufacturing device, a period for exhausting process gas, a period for not performing gas inflow, and a period for stopping the pump are repeated across a long period of time, for example.

Figures 5A, 5B, 5C, 5D:
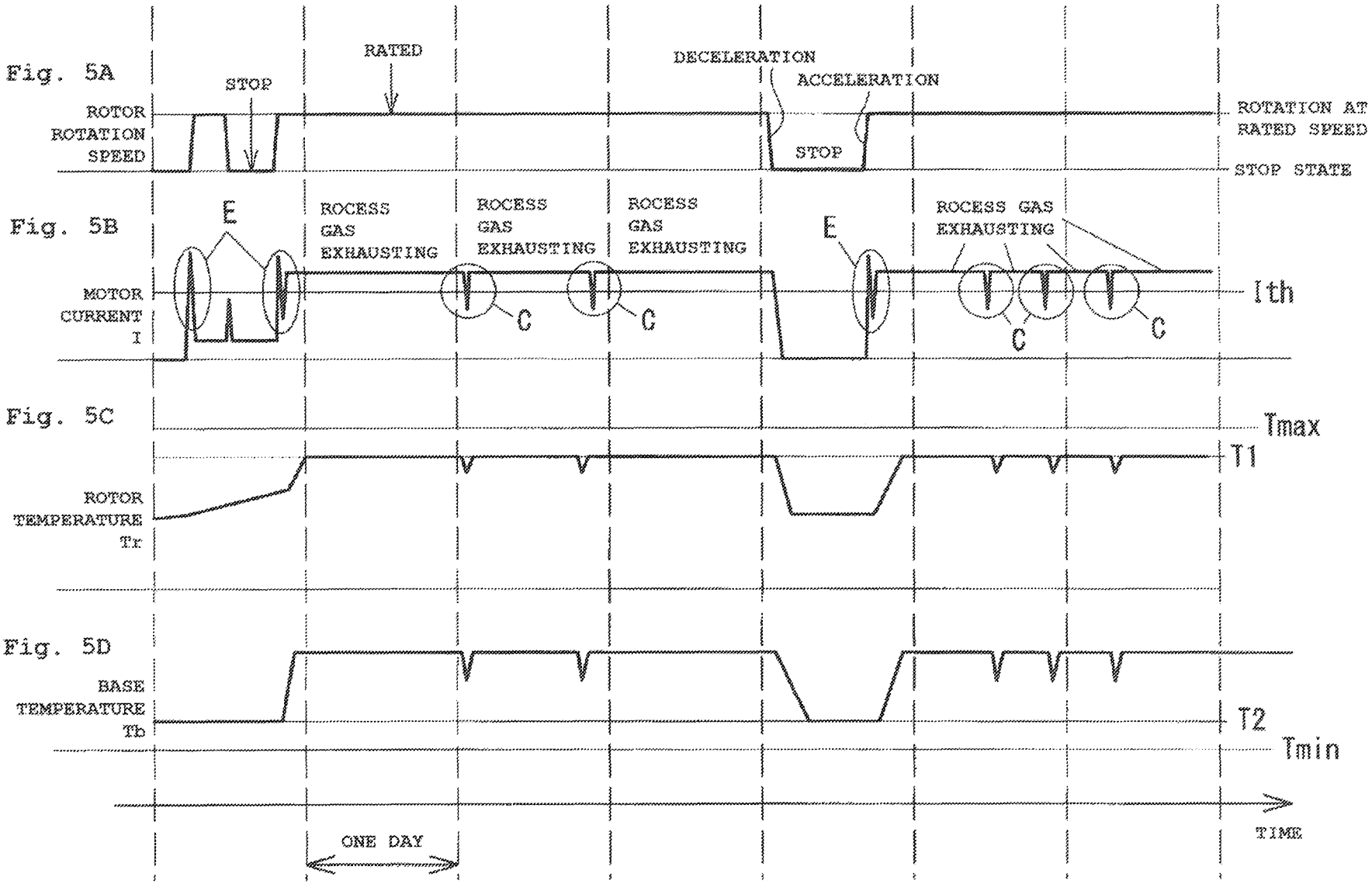
FIGS. 5A to 5D are graphs of an example of a short-term operation state of a vacuum pump attached to a semiconductor manufacturing device.
Figures 6A, 6B, 6C, 6D:
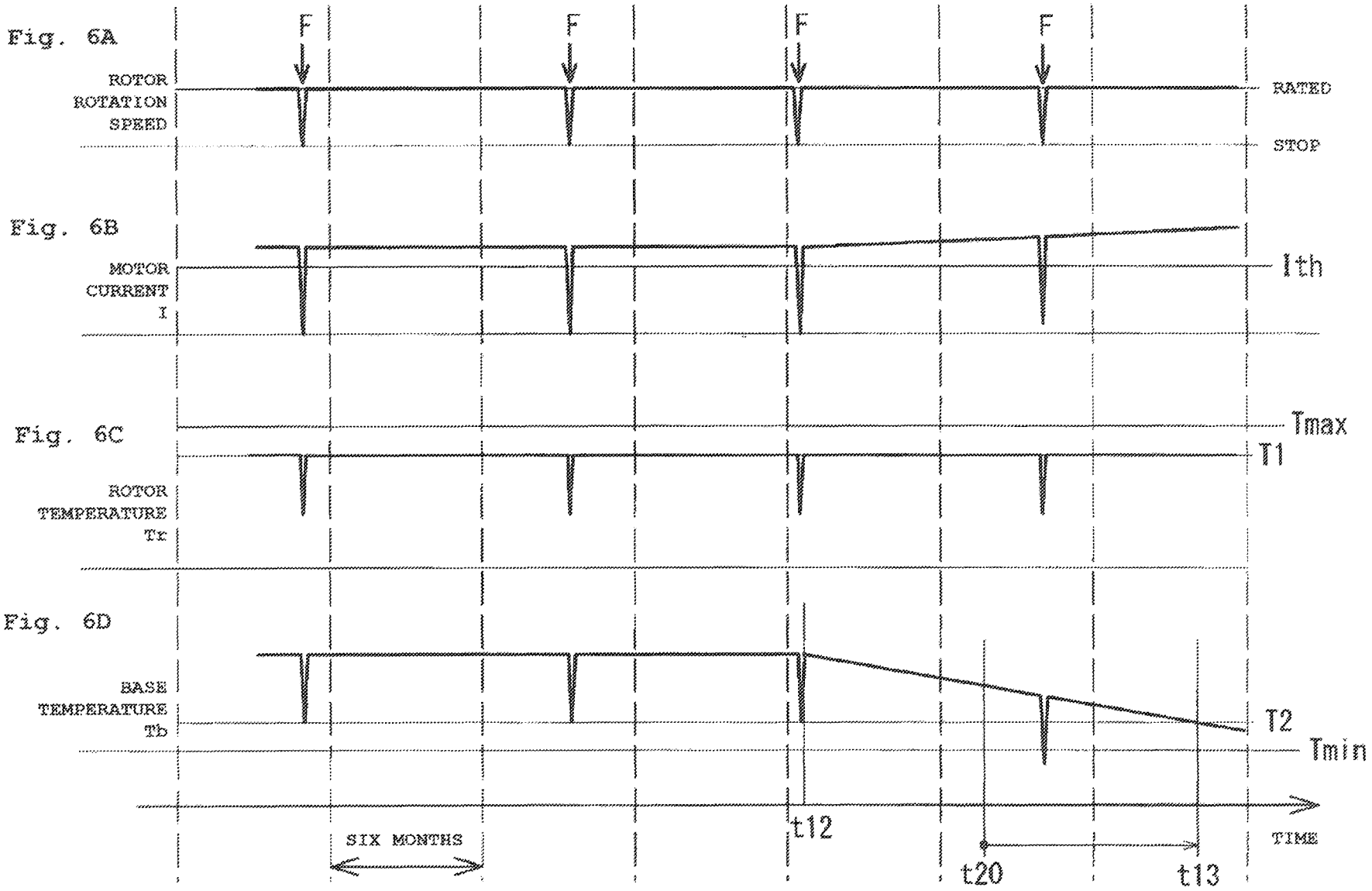
FIGS. 6A to 6D are graphs of an example of a long-term operation state of the vacuum pump attached to the semiconductor manufacturing device.

FIGS. 5A to 5D and FIGS. 6A to 6D are graphs of an example of the operation state of the vacuum pump attached to the semiconductor manufacturing device. FIGS. 5A to 5D show a short-term (about one week) status, and FIGS. 6A to 6D show a long-term status across several months. In FIGS. 5A to 5D and FIGS. 6A to 6D, A shows the rotor rotation speed, B shows the motor current value I, C shows the rotor temperature Tr, and D shows the base temperature Tb. Note that the rotor rotation speed of FIG. 5A is shown together with the operation state (stop, rotation at the rated speed, deceleration, acceleration).

As shown in FIGS. 5A to 5D, process gas exhausting is performed when the rotor rotation speed is the rated rotation speed. The graph of the motor current value I shows that the motor current value I decreases at a point indicated by a reference character "C." This is because gas inflow is stopped between a certain process and a subsequent process, and therefore, the motor current value I decreases with a decrease in a motor load. Moreover, a point indicated by a reference character "E" is a point at which the operation state switches from acceleration to rotation at the rated speed. At such a point, the motor current value I also greatly decreases. Thus, when a rated rotation speed state in which the rotor rotation speed is substantially the rated rotation speed is brought and the motor current value I satisfies I≥Ith, such a state can be determined as a process gas exhaust state, i.e., the state in which gas flows into the pump.

In FIGS. 6A to 6D showing the long-term trend, a period indicated by a reference character "F" corresponds to a period shown as "stop" in FIG. 5A. In the period F, the motor current value I, the rotor temperature Tr, and the base temperature Tb greatly decrease. Moreover, after the time point t12, the base temperature Tb gradually decreases. This corresponds to a change in the base temperature Tb indicated by the curve L23 after the time point t12 of FIG. 4B. The base temperature Tb reaches the predetermined temperature T2 at the time point t13, and falls below the predetermined temperature T2 after the time point t13.

Note that when a series of processes to be executed includes three processes corresponding respectively to the curves L21 to L23 of FIG. 4B, the base temperature Tb detected according to an executed process is any temperature within a temperature range inside the curves L21 to L23.

(Estimation of Maintenance Timing)

In the present embodiment, the time point t13 at which the base temperature Tb reaches the predetermined temperature T2 is taken as the maintenance timing for removal of the accumulated substance, and such maintenance timing is estimated by calculation. For example, at a time point t20, the change in the base temperature Tb after the time point t20 is predicted based on multiple base temperatures Tb detected until the time point t20, and a time point satisfying Tb=T2 is estimated.

Figure 7:
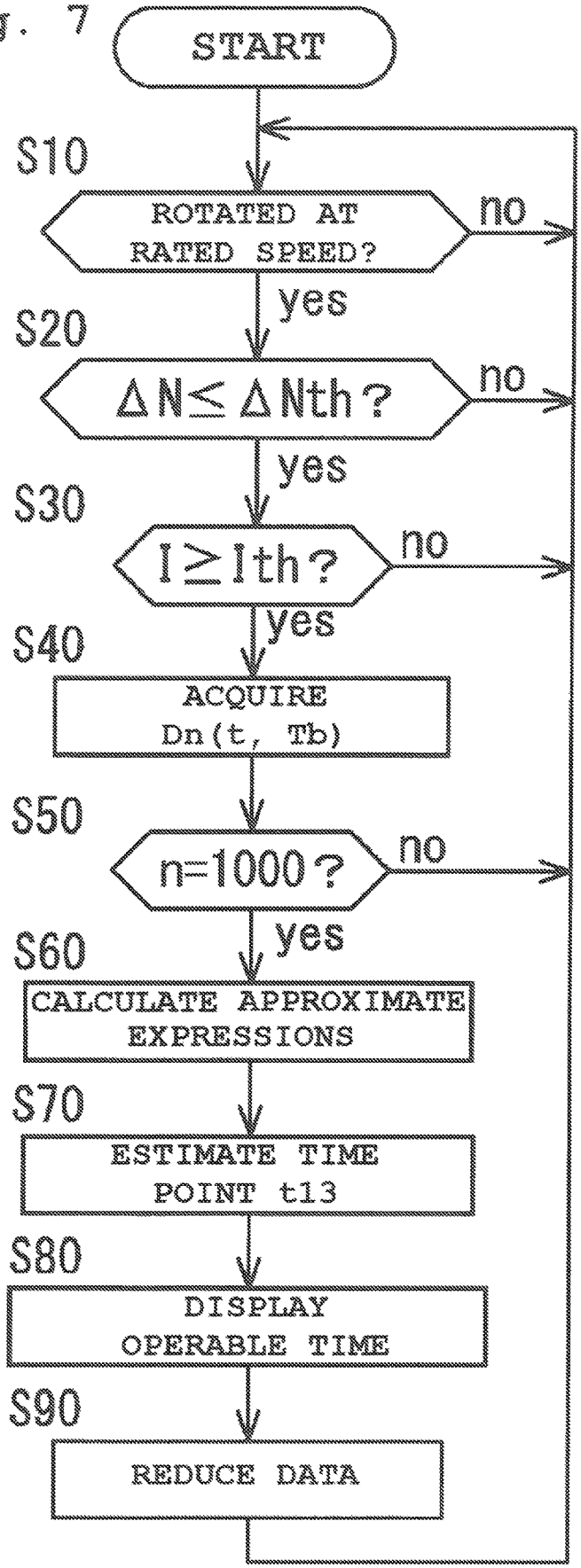
FIG. 7 is a flowchart of an example of the processing of estimating maintenance timing.

FIG. 7 is a flowchart of an example of the processing of estimating the timing of maintenance performed at the monitoring device 100. Steps S10 to S30 are the processing of determining whether or not the vacuum pump is in the process gas exhaust state.

A process in a semiconductor device is performed with a pressure in a process chamber being stabilized. Process gas flows into the process chamber after the vacuum pump has been brought into the rated rotation speed state. The motor load increases in association with start of gas inflow. Thus, after start of gas inflow, the rotation speed temporarily decreases. Then, the rotation speed increases and stays at the rated rotation speed. Moreover, as illustrated in FIGS. 5A to 5D, the motor current value I in process gas exhausting is greater than a threshold Ith.

Thus, the process gas exhaust state can be determined based on whether or not the following three conditions are satisfied: the state status is rotation at the rated speed; a temporal change ΔN in the rotation speed N is equal to or smaller than a predetermined threshold ΔNth; and the motor current value I satisfies I≥Ith. The threshold Ith and the threshold ΔNth are conditions for determining whether or not the process gas exhaust state is brought, and are set in advance. For example, the predetermined threshold ΔNth is set to ΔNth=100 [rpm/min].

(Step S10)

At a step S10, it is determined whether or not the state status on the rotation state of the vacuum pump is rotation at the rated speed. Such a state status is input from the control unit 2.

(Step S20)

At a step S20, for the rotor rotation speed detected by the rotation sensor 43, it is determined whether or not the temporal change ΔN in the rotation speed N is equal to or smaller than the predetermined threshold ΔNth.

(Step S30)

At a step S30, it is determined whether or not the motor current value I detected by the current detection section 27 satisfies I≥Ith.

(Step S40)

When it is determined as "yes" at all of the steps S10, S20, S30, data sets Dn (tn, Tbn) are acquired at a step S40. The acquired data sets Dn (tn, Tbn) are stored in the storage section 103. On the other hand, when it is determined as "no" at any of the steps S10, S20, S30, the process returns to the step S10.

Each data set Dn (tn, Tbn) contains a base temperature Tb and a time point t at which such a temperature is detected. Note that a default value D0 (t0, Tb0) of the data set Dn(tn, Tbn) is a data set acquired in the initial pump operation state of FIGS. 4A and 4B and FIGS. 5A to 5D. The storage section 103 ensures, as a data storage area for data sets, a data storage area for 1001 data sets including the default value D0 (t0, Tb0) and other 1000 data sets Dn(tn, Tbn).

(Step S50)

At a step S50, it is determined whether or not the number of acquired data sets other than the default value D0 (t0, Tb0) reaches 1000. When the acquired data number n is less than 1000, the process returns to the step S10. When the acquired data number n reaches 1000, the process proceeds to a step S60.

(Step S60)

At the step S60, an approximate expression for predicting the change in the base temperature Tb is calculated in the estimation section 105 based on the data sets D0 (t0, Tb0), D1 (t1, Tb1) to D1000 (t1000, Tb1000) stored in the storage section 103. Three types of expressions, i.e., primary, secondary, and tertiary expressions, are calculated herein as approximate expressions, but the present invention is not limited to these expressions. A base expression for each of the primary, secondary, and tertiary expressions is set as in the following expressions (1) to (3), and each coefficient value is obtained by calculation employing a least-square technique:

$$Tb=b1\cdot t+a1 \quad (1)$$

$$Tb=c2\cdot t^2+b2\cdot t+a2 \quad (2)$$

$$Tb=d3\cdot t^3+c3\cdot t^2+b3\cdot t+a3 \quad (3)$$

(Step S70)

At a step S70, the extrapolation calculation processing of obtaining the time point t13 at which the base temperature Tb reaches the predetermined temperature T2 is performed using the approximate expressions calculated at the step S60. That is, a point at which a base temperature curve expressed by the approximate expressions intersects with the line of the predetermined temperature T2 is obtained by, e.g., dichotomization. As shown in FIGS. 6A to 6D, an operable time until the base temperature Tb reaches the predetermined temperature T2 is t13 to t20, supposing that a present time point at which calculation is made is t20.

(Step 80)

Figure 8:
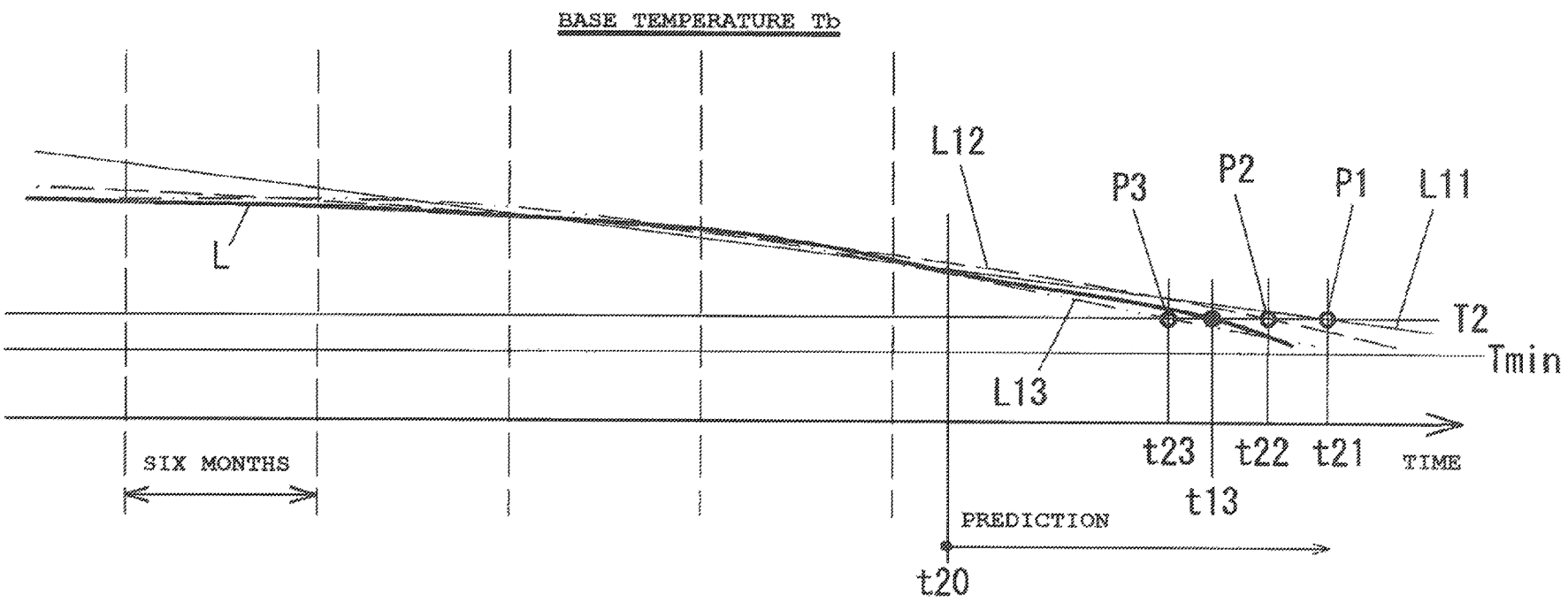
FIG. 8 is a graph of approximate curves L11, L12, L13.

At a step S80, the above-described operable time is displayed on the display section 104 as maintenance information indicating the maintenance timing, and such maintenance information is output as information on the operable time from the output section 108. Note that instead of displaying and outputting the operable time, time points t21, t22, t23 may be displayed and output as the maintenance information. For example, approximate curves L11 to L13, the time points t21 to t23, and the predetermined temperature T2 as described later with reference to FIG. 8 are displayed as an display example of the display section 104.

(Step S90)

Next, the reduction processing of reducing, to 500 data sets, the 1000 data sets D1 (t1, Tb1) to D1000 (t1000, Tb1000) stored in the storage section 103 is executed in the compression section 102*b* at a step S90. By such reduction processing, the data sets stored in the storage section 103 is reduced to 500 data sets excluding the default value D0 (t0, Tb0). A free space for 500 data sets is formed in the data storage area. The reduction processing is described later in detail.

When the reduction processing of the step S90 is completed, the process returns to the step S10 to newly accumulate 500 data sets in the free space formed by the reduction processing. As described above, approximate expression calculation is performed every time the acquired data set number reaches 1001 data sets, and the time point t13 at which the base temperature Tb reaches the predetermined temperature T2 is calculated.

(Approximate Curves)

FIG. 8 schematically shows the approximate curves L11, L12, L13 when a base temperature curve L and the base temperature Tb are estimated using the primary, secondary, and tertiary expressions based on the data sets for the time points up to the time point t12. The base temperature curve L shows a continuous curve of sampled base temperatures Tb (discrete values). In an example shown in FIG. 8, the base temperature curve L intersects with the line of the predetermined temperature T2 at the time point t13.

The approximate curves L11, L12, L13 are, at the time point t20, approximate curves of the base temperature Tb calculated based on the base temperature data sets before the time point t20. The approximate curves L11, L12, L13 each intersect with the line of the predetermined temperature T2 at a corresponding one of points P1, P2, P3.

For example, when a time point at which the base temperature Tb reaches T2 is estimated using the approximate curve L11, such a time point is a time point t21. Thus, the operable time from the present time point (the time point t20) is (t21−t20). Similarly, in the case of using the approximate curve L12, the base temperature Tb reaches the predetermined temperature T2 at a time point t22, and therefore, the operable time is estimated as (t22−t20). In the case of using the approximate curve L13, the base temperature Tb reaches the predetermined temperature T2 at a time point t23, and the operable time is estimated as (t23−t20).

Note that a condition allowing passage nearby a present value (the data set at the time point t20) may be added such that a present side is more weighted as compared to a past side. Alternatively, approximation is made using a straight line passing through the default value D0 (to, Tb0) and the present value D20 (t20, Tb20), thereby reducing the memory capacity and facilitating calculation. An approximate expression in this case is represented by the following expression (4). Note that b=(Tb20−Tb0)/(t20−t0) and a=Tb0 are satisfied.

$$Tb=b\cdot(t-t0)+a \quad (4)$$

(Reduction Processing)

An example of the reduction processing will be described. The data sets Dn (tn, Tbn) are input at a predetermined sampling interval Δt from the communication section 24 of the control unit 2 to the communication section 101. The data sets Dn (tn, Tbn) include those which are not in the process gas exhaust state. However, for the sake of simplicity of description, all of the sampled data sets Dn (tn, Tbn) are in the process gas exhaust state.

First, the default value D0 (t0, Tb0) and 1000 data sets D1(Δt, Tb1), D2(2Δt, Tb2), D3(3Δt, Tb3), D4(4Δt, Tb4), . . . , D999(999Δt, Tb999), D1000(1000Δt, Tb1000) are accumulated in the storage section 103. These 1000 data sets D1(Δt, Tb1) to D1000 (1000Δt, Tb1000) are reduced to 500 data sets D1 ((3/2) Δt, (Tb1+Tb2)/2), D2((7/2)Δt, (Tb3+Tb4)/2), . . . , D499((1995/2)Δt, (Tb997+Tb998)/2), D500 ((1999/2)Δt, (Tb999+Tb1000)/2).

Note that the average of the base temperatures Tb is herein obtained for adjacent two of the data sets. The reduction processing is performed using such an average as the base temperature at a middle time point between adjacent two of the data sets. Note that such reduction processing is an example, and various types of reduction processing are available. For example, the case where the sampling interval Δt is constant has been described herein, but such a sampling interval is not necessarily constant.

After the approximate expressions have been calculated using the above-described 1001 data sets, 500 data sets are newly accumulated in the storage section 103. Thus, a first one of the new 500 data sets is a data set sampled after a lapse of a time required for approximate expression calculation from the sampling time point of the 1000th data set D1000(1000Δt, Tb1000) described above, i.e., a sampling time point of 1000Δt. In the present embodiment, the time required for approximate expression calculation is not taken into consideration, and the sampling time point of the first one of the new 500 data sets is described as 1000Δt+Δt=1001Δt. That is, the new 500 data sets D1001 (1001Δt, Tb1001), D1002 (1002Δt, Tb1002), . . . , D1500 (1500Δt, Tb1500) are accumulated in the storage section 103.

As a result, the default value D0 (t0, Tb0) and the 1000 data sets are accumulated in the storage section 103. Using these 1001 data sets, calculation of the approximate expressions of the step S60 is performed. In the reduction processing of the step S90, the reduction processing is performed for the above-described 1000 data sets D1((3/2)Δt, (Tb1+Tb2)/2), D2((7/2)Δt, (Tb3+Tb4)/2), . . . , D499((1995/2)Δt, (Tb997+Tb998)/2), D500((1999/2)Δt, (Tb999+Tb1000)/2), D1001(1001Δt, Tb1001), D1002(1002Δt, Tb1002), . . . , D1500(1500Δt, Tb1500).

Figure 9:
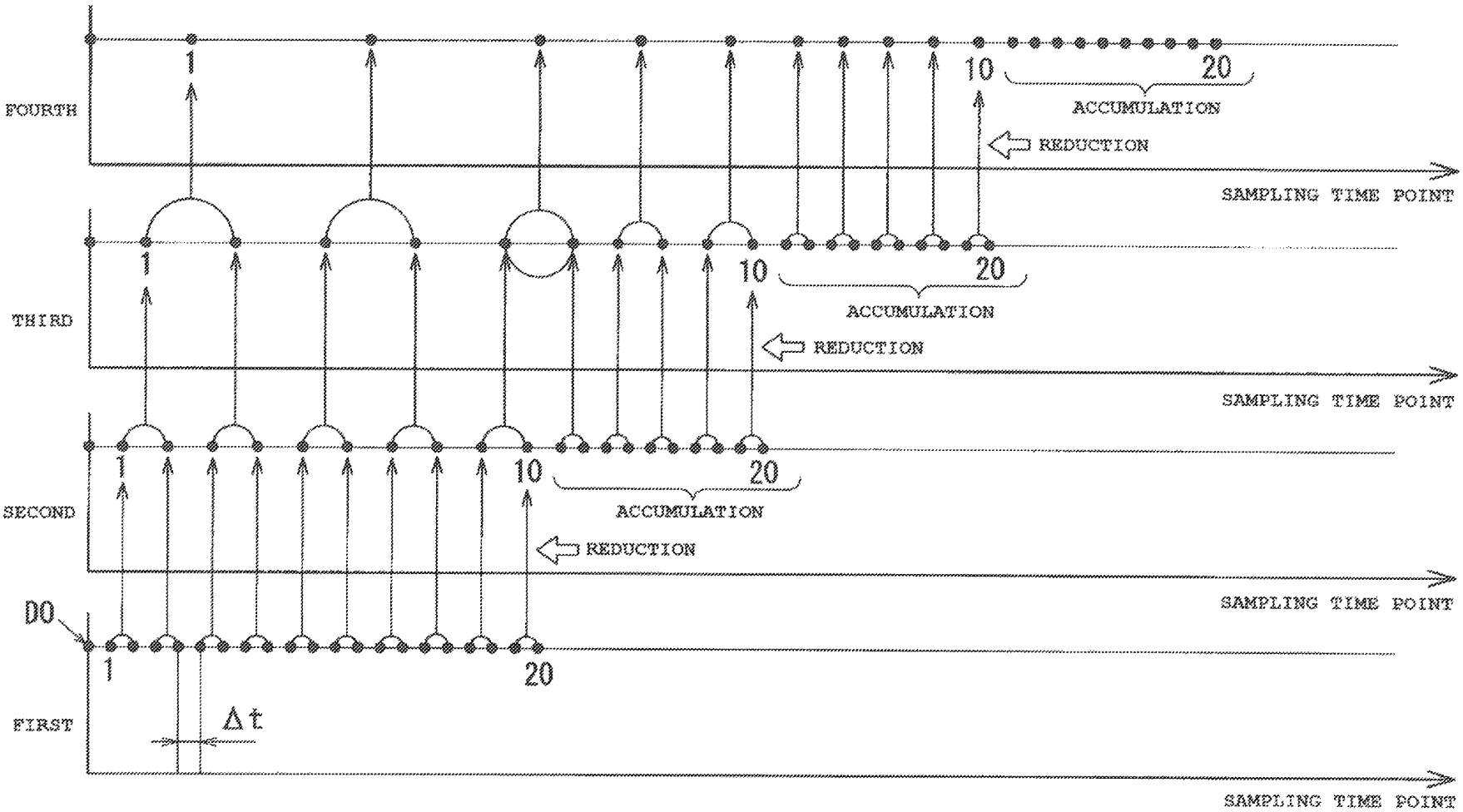
FIG. 9 is a graph for describing reduction processing.

FIG. 9 is a graph for describing the reduction processing. In FIG. 9, the case where 21 data sets, i.e., the default value D0 (t0, Tb0) and 20 data sets Dn(tn, Tbn), can be stored in the data storage area of the storage section 103 is shown as an example. In FIG. 9, a black circle represents a data set, and the horizontal axis represents a sampling time point. Moreover, the number shown under the black circle represents a sequential order in the data sets Dn(tn, Tbn). In FIG. 9, first to fourth data sets for approximate expression calculation are shown in the order from the lower side to the upper side as viewed in the figure.

In first approximate expression calculation, the approximate expressions are calculated using the 21 data sets sampled at a Δt interval and including the default value D0(t0, Tb0). Then, the reduction processing is performed for 20 data sets excluding the default value D0 (t0, Tb0). As a result, the 21 data sets are reduced to 11 data sets, and a free space for 10 data sets is formed in the storage section 103. Then, 10 data sets are newly accumulated in such a free space of the data storage area.

In second approximate expression calculation, the approximate expressions are calculated based on the default value D0(t0, Tb0), the 10 data sets remaining after the reduction processing, and the 10 data sets newly accumulated. Subsequently, the reduction processing is performed for 20 data sets excluding the default value D0 (t0, Tb0), and a free space for 10 data sets is ensured in the data storage area of the storage section 103. Then, 10 data sets are newly accumulated in such a free space. Third and fourth approximate expression calculations of FIG. 9 are further performed as in the second approximate expression calculation.

(A) As described above, in the present embodiment, the vacuum pump includes the stationary blades 31 and the stator 32 provided at the base 3, the pump rotor 4*a* rotatably driven on the stationary blades 31 and the stator 32, the heater 5 as a heating section configured to heat the base 3, a base temperature sensor 6 as a base temperature detection section configured to detect the temperature of the base 3, the rotor temperature sensor 8 configured to detect a magnetic permeability change amount which is a temperature equivalent as a physical amount equivalent to the temperature of the pump rotor 4*a*, and the temperature control section 22 as a heating control section configured to control heating of the base 3 by the heater 5 such that a detection value of the rotor temperature sensor 8 falls within a predetermined target value range. The monitoring device 100 of this vacuum pump includes the estimation section 105 configured to estimate, based on multiple base temperatures Tb detected over time, the timing (the time points t21, t22, t23 of FIG. 8) at which the base temperature Tb reaches the predetermined temperature T2, and the display section 104 and the output section 108 configured to output the maintenance information (e.g., the time point t21 or the operable time t21–t20) based on the estimated timing.

As described above, the timing (the time points t21 to t23) at which the base temperature Tb reaches the predetermined temperature T2 is estimated based on the actually-measured base temperatures Tb, and therefore, the timing requiring maintenance can be accurately estimated regardless of the process type being performed. For example, in the case of performing the process shown by the curve L21, the base temperature Tb changes as shown in the curve L21. Subsequently, when the process is changed to the process shown by the curve L23, the base temperature Tb changes toward the curve L23. Since the curve L23 shows a lower base temperature Tb than that of the curve L21, the maintenance timing is advanced than the estimated timing, and the operable time is shortened.

On the other hand, in the method in which accumulation is predicted based on a change from a default value of a motor current value as in Patent Literature 1, even after a process has been changed, the motor current value stays about the same as long as a gas flow rate does not change. For this reason, the estimated maintenance timing stays about the same before and after a process change. Even if only data in process can be detected under favorable conditions, the maintenance timing is estimated delayed as compared to actual maintenance timing.

Moreover, in the present embodiment, control is made such that the detection value (the rotor temperature Tr) of the rotor temperature sensor 8 falls within the predetermined target value range as shown in FIGS. 3A, 3B, 4A, and 4B, and therefore, the rotor creep life can be easily predicted. Further, the rotor temperature Tr can reach around an optimal upper temperature limit, and accordingly, the base temperature Tb can be as high as possible. Thus, the operable time against accumulation can be extended.

(B) Further, the selection section 102*a* of the data processing section 102 determines, based on the temporal change ΔN in the rotation speed and the motor current value I, whether or not the vacuum pump is in the gas inflow state, and stores, in the storage section 103, the sampled base temperature data sets in the gas inflow state. Based on the data sets stored in the storage section 103, i.e., the base temperature data sets sampled when it is determined that the vacuum pump is in the gas inflow state, the estimation section 105 may estimate the timing at which the pump base temperature reaches the threshold.

As described above, approximate calculation is performed based on the base temperatures Tb acquired in the pump exhaust state under the same conditions, and therefore, a calculation accuracy can be further improved. Influence of the accumulated substance on a decrease in the base temperature Tb is more notably produced in the state in which gas flows in the vacuum pump than in the state in which no gas flows in the vacuum pump. Thus, the base temperatures Tb sampled when gas flows in the vacuum pump are used so that the influence of the accumulated substance can be more accurately grasped.

(C) The base temperature data sets D0 to D1000 each containing the pump base temperature and the sampling time point thereof are stored in the storage section 103, and the timing at which the base temperature Tb reaches the threshold (the predetermined temperature T2) is estimated based on the stored base temperature data sets D0 to D1000. In this configuration, the data processing section 102 performs the processing of performing greater weighting on a base temperature data set whose sampling time point is more recent. Then, the estimation section 105 may perform estimation based on the weighted base temperature data set.

A greater accumulated substance amount results in a greater decrease in the base temperature Tb, but such a decrease in the base temperature Tb is not proportional to the amount of the accumulated substance. Generally, a greater accumulated substance amount results in a higher degree of a temperature decrease. For this reason, for estimation of a future base temperature change rather than a present base temperature change, an estimation accuracy is higher in the case of performing approximate calculation with more emphasizing of a base temperature sampled at a time point closer to the present time point than in the case of using base temperature data sets equally weighted and acquired across a long period of time. Thus, the processing of performing greater weighting on the base temperature data set whose sampling time point is more recent is performed so that the base temperature estimation accuracy can be improved.

For example, it has been found that when the reduction processing as shown in FIG. 9 is performed, the number of older base temperature data sets stored in the storage section 103 decreases every time the reduction processing is repeated. Thus, the substantially half of the base temperature data sets stored in the storage section 103 becomes the base temperature data sets acquired recently. That is, by performing the reduction processing as shown in FIG. 9, the base temperature data set whose sampling time is more recent is more weighted.

Further, by performing the above-described reduction processing, an approximation accuracy is increased while a data storage capacity is suppressed low.

Various embodiments and variations thereof have been described above, but the present invention is not limited to the contents of theses embodiments and variations. For example, the monitoring device 100 is separately provided in the above-described embodiment, but may be provided at the control unit 2. Alternatively, only some of functions of the monitoring device 100 may be provided at the control unit 2. Other aspects conceivable within the scope of the technical idea of the present invention are included in the scope of the present invention.

What is claimed is:

1. A vacuum pump, comprising:

a rotor, a stator provided at a pump base portion, a motor configured to drive the rotor, a heater configured to heat the pump base portion, a base temperature sensor provided at the pump base portion or the stator and configured to detect a temperature of the pump base portion, a rotor temperature sensor different from the base temperature sensor and configured to detect a temperature equivalent as a physical amount equivalent to a temperature of the rotor, and a heating controller configured to control heating of the pump base portion by the heater based on a detection value of the rotor temperature sensor, such that the detection value of the rotor temperature sensor falls within a predetermined target value range, wherein the temperature of the pump base portion causing the detection value of the rotor temperature sensor to fall within the predetermined target value range decreases as accumulation of product in the vacuum pump increases, and the vacuum pump further comprising:

an estimation section configured to estimate, based on multiple temperatures detected over time by the base temperature sensor, maintenance timing of product in the vacuum pump, the maintenance timing being an estimated time at which the temperature of the pump base portion resulting in the detection value of the rotor temperature sensor falling within the predetermined target value range will decrease, as accumulation of product in the vacuum pump increases, to a value equal to or lower than a predetermined temperature; and an output section configured to output maintenance information based on the estimated maintenance timing.

2. The monitoring device according to claim 1, wherein the vacuum pump further includes a rotation speed sensor configured to detect a rotation speed of the rotor and a current detection section configured to detect a motor current value of the motor, a determination section configured to determine, based on a temporal change in the rotation speed and the motor current value, whether or not the vacuum pump is in a gas inflow state is further provided, and the estimation section performs estimation based on the temperature detected by the base temperature sensor when the determination section determines as being in the gas inflow state.

3. The monitoring device according to claim 1, further comprising:

a storage section configured to store, for the multiple temperatures detected over time by the base temperature sensor, data sets in a data storage area, each data set containing a temperature and a detection time point thereof, wherein the estimation section performs estimation based on the multiple data sets stored in the storage section.

4. The monitoring device according to claim 3, further comprising:

a data processing section configured to perform, for the data sets stored in the storage section, greater weighting on a data set whose detection time point is more recent, wherein the estimation section performs estimation based on the data set weighted by the data processing section.

5. The monitoring device according to claim 4, wherein the data processing section performs averaging processing of reducing a data set number stored in the storage section, and stores a new data set in a free space of the data storage area formed by the averaging processing.

* * * * *